US006074201A

United States Patent [19]

Mühle

[11] Patent Number: 6,074,201

[45] Date of Patent: Jun. 13, 2000

[54] GAS BURNER CONFIGURATION FOR COOKING AREAS

[75] Inventor: Bernd Mühle, Kirchmanschöring, Germany

[73] Assignee: BSH Bosch und Siemens Hausgeraete GmbH, Munich, Germany

[21] Appl. No.: 09/220,243

[22] Filed: Dec. 23, 1998

[30] Foreign Application Priority Data

Dec. 23, 1997 [DE] Germany ..... 197 57 732

[51] Int. Cl.[7] ..... F23D 14/62; F24C 3/00

[52] U.S. Cl. ..... 431/354; 431/12; 126/39 N; 126/39 R; 126/39 H; 126/39 J

[58] Field of Search ..... 431/354, 12; 126/39 N, 126/39 K, 39 H, 39 J

[56] References Cited

U.S. PATENT DOCUMENTS

| | | | |
|---|---|---|---|
| 1,286,493 | 12/1918 | Bailey | 126/39 N |
| 1,736,473 | 11/1929 | Wilde | 126/39 K |
| 2,781,779 | 2/1957 | Kindl | 126/39 N |
| 4,236,503 | 12/1980 | Kemp | 126/39 K |
| 5,209,217 | 5/1993 | Beach et al. | 431/354 |
| 5,213,091 | 5/1993 | Beach | 431/354 |
| 5,740,789 | 4/1998 | Chang | 126/39 K |

FOREIGN PATENT DOCUMENTS

| | | | |
|---|---|---|---|
| 167730 | 8/1921 | United Kingdom | 126/39 K |

*Primary Examiner*—Ira S. Lazarus
*Assistant Examiner*—David Lee
*Attorney, Agent, or Firm*—Herbert L. Lerner; Laurence A. Greenberg; Werner H. Stemer

[57] ABSTRACT

A gas burner configuration for cooking areas includes a gas fitting for supplying gas to a gas burner and a first setting member for the gas fitting. An adjusting pipe is disposed in the vicinity of a gas injector nozzle configuration. The adjusting pipe can be displaced longitudinally toward the gas burner along an opening for a feed pipe supplying a gas/air mixture and can be varied through the use of a second setting member disposed in the vicinity of the first setting member, for optimizing a gas/air mixture by varying an air induction effect in an injector region.

4 Claims, 4 Drawing Sheets

GAS BURNER CONFIGURATION FOR COOKING AREAS

BACKGROUND OF THE INVENTION

Field of the Invention

The present invention relates to a gas burner configuration for cooking areas, including a gas injector nozzle configuration disposed between a gas feed setting fitting and a gas burner site and having a pipe leading to a burner head, an opening in the pipe, an adjusting pipe to be displaced longitudinally and a gas outlet nozzle disposed in the vicinity of the opening.

Gas burner configurations for cooking areas have a gas injector nozzle configuration functionally interposed between a setting fitting for metering a combustion gas feed and a burner head at a cooking area. The gas injector nozzle configuration has a gas nozzle of a pipe which is led to the gas burner head and through which a gas/air mixture is led to the burner head. The gas/air mixture is formed of gas flowing out from the gas nozzle and air inducted as so-called primary air from the surroundings of the pipe opening. Various types of combustion gas which are stored at various pressures of the gas fitting, or are available from a local or regional gas supply, are used as the combustion gas. In order to provide an optimum combustion performance, that is to say for optimum use of the energy of the gas, and in particular to avoid or reduce harmful exhaust gases, it is necessary to optimize the ratio of combustion gas to primary air as far as possible, to conform to the type of gas and also, if appropriate, to air conditioning set-up at the place of use. The type of gas being used is widely taken into account by the appropriate selection of the nozzle in the gas injector nozzle configuration. However, configurations have also become known in which the inlet opening of the pipe for the gas/air mixture is varied, specifically, for example, by virtue of the fact that the diameter of the opening or the position of the opening relative to the gas nozzle is varied.

SUMMARY OF THE INVENTION

It is accordingly an object of the invention to provide a gas burner configuration for cooking areas, which overcomes the hereinafore-mentioned disadvantages of the heretofore-known devices of this general type and with the aid of which it is possible to optimize a gas/air mixture fed to a burner head for a combustion process, in a simple way.

With the foregoing and other objects in view there is provided, in accordance with the invention, a gas burner configuration for cooking areas, comprising a gas burner disposed at a gas burner site; a gas feed setting fitting for gas to be fed to the gas burner; a gas injector nozzle configuration disposed between the gas fitting and the gas burner site, the gas injector nozzle configuration having a pipe leading to the burner head, the pipe having an air inlet opening formed therein, and the gas injector nozzle configuration having an adjusting pipe to be displaced longitudinally and a gas outlet nozzle disposed in the vicinity of the opening; a first setting member for the gas fitting; and a second setting member disposed in the vicinity of the first setting member for adjusting the air inlet opening of the gas injector nozzle configuration.

In accordance with another feature of the invention, the air inlet opening of the gas injector nozzle configuration can be varied through the use of a sleeve as an adjusting member, which can be adjusted in alignment with a duct for the gas/air mixture that leads to the burner head.

In accordance with a further feature of the invention, the second adjusting member is a finger-grip knob configuration having an actuating knob which is disposed on an operating panel next to an operating knob for regulating the gas feed through the use of the gas fitting, and can be actuated by an operator who observes the flame pattern and corrects it.

In accordance with a concomitant feature of the invention, there is provided a toggle lever which is pivotably mounted in a housing and engages in a self-closed manner, at one of its lever arm ends, with the adjusting sleeve and, with its other lever arm, in a slide of the second setting member, in order to transmit an adjusting stroke desired by the operator onto the adjusting sleeve in the vicinity of the gas injector nozzle configuration.

Other features which are considered as characteristic for the invention are set forth in the appended claims.

Although the invention is illustrated and described herein as embodied in a gas burner configuration for cooking areas, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
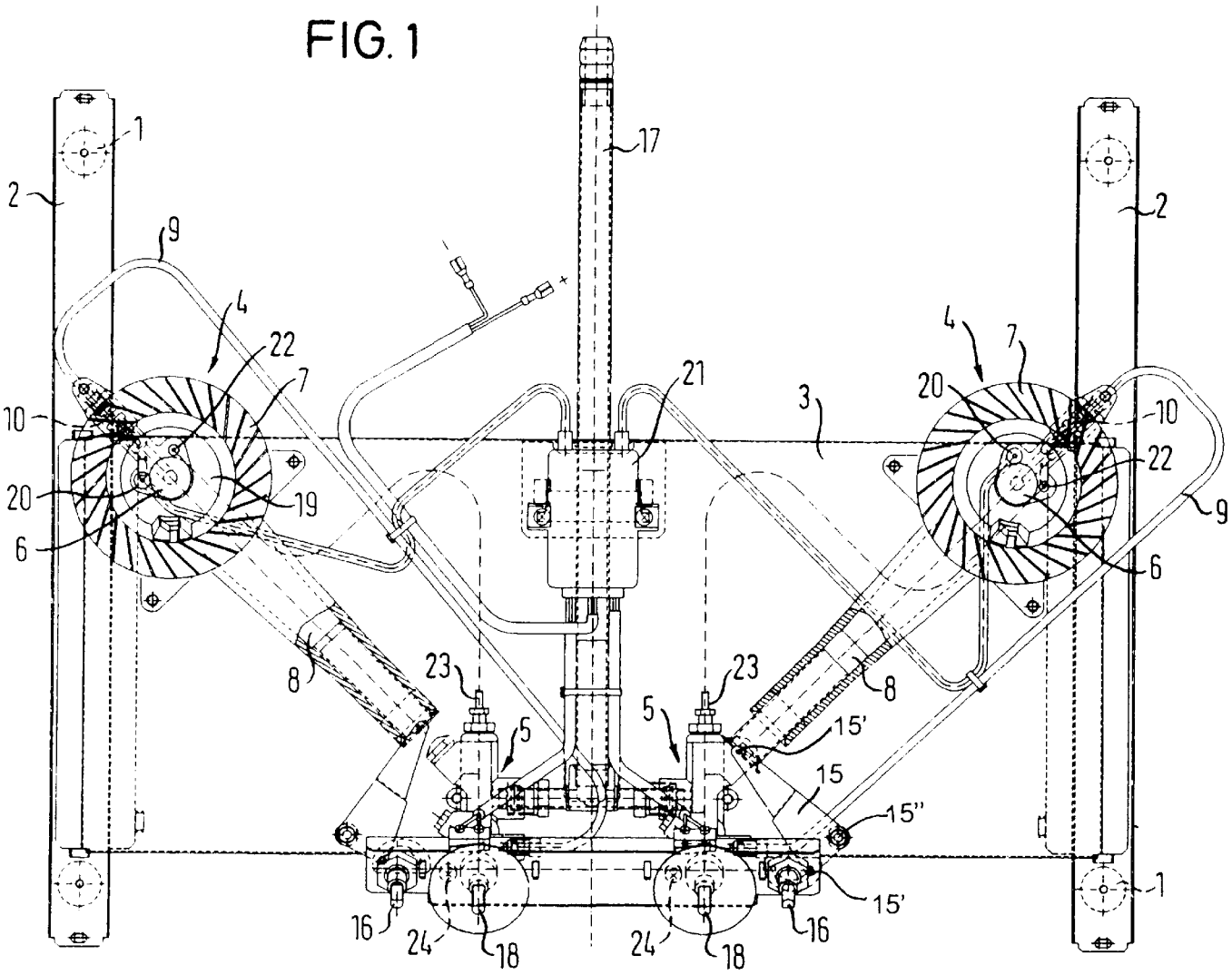
FIGS. 1 and 2 are diagrammatic, plan views of configurations each having two cooking areas and an associated burner fitting, without an associated housing and without an associated cover with pot supporting units.
Figure 2:
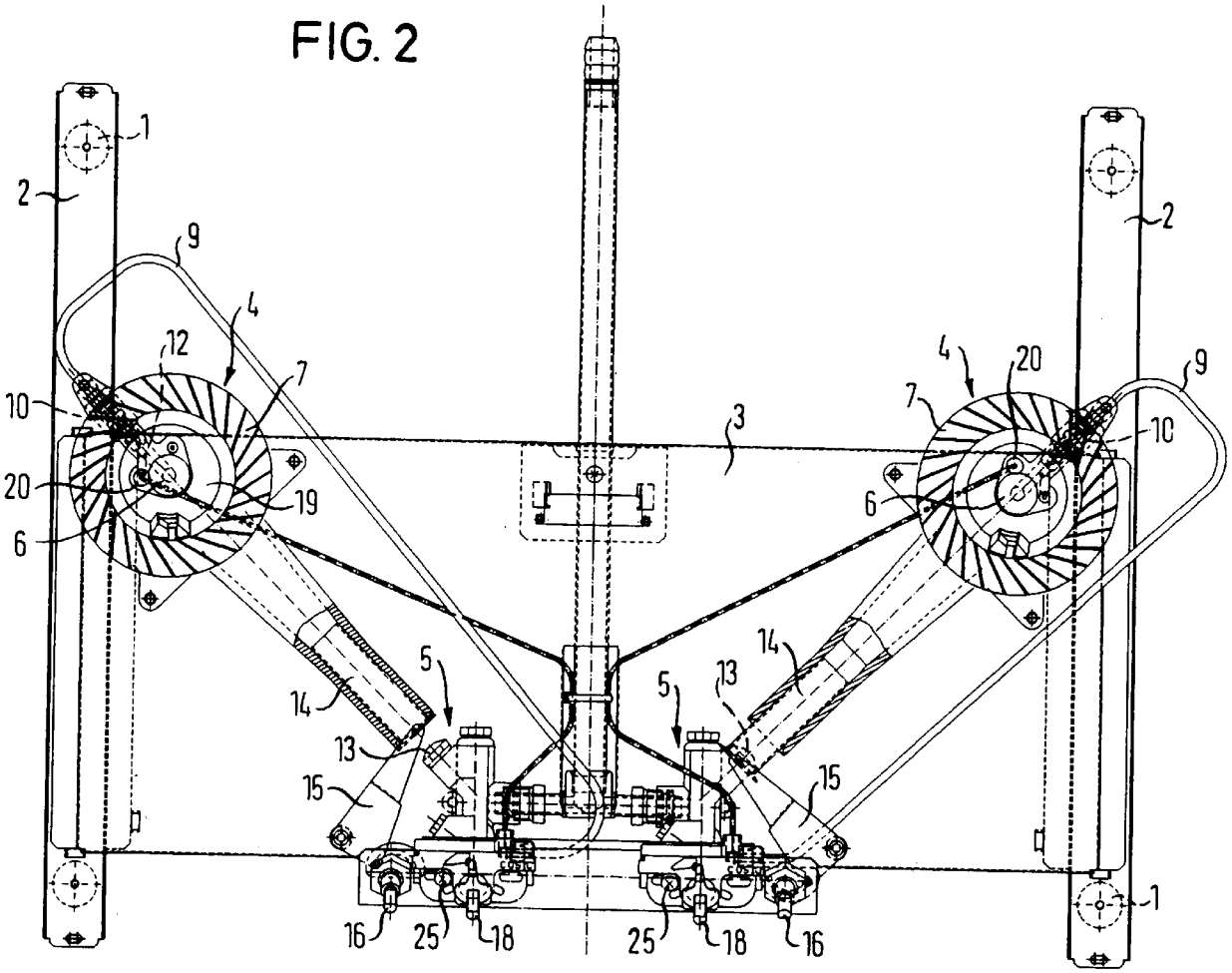
Figure 3:
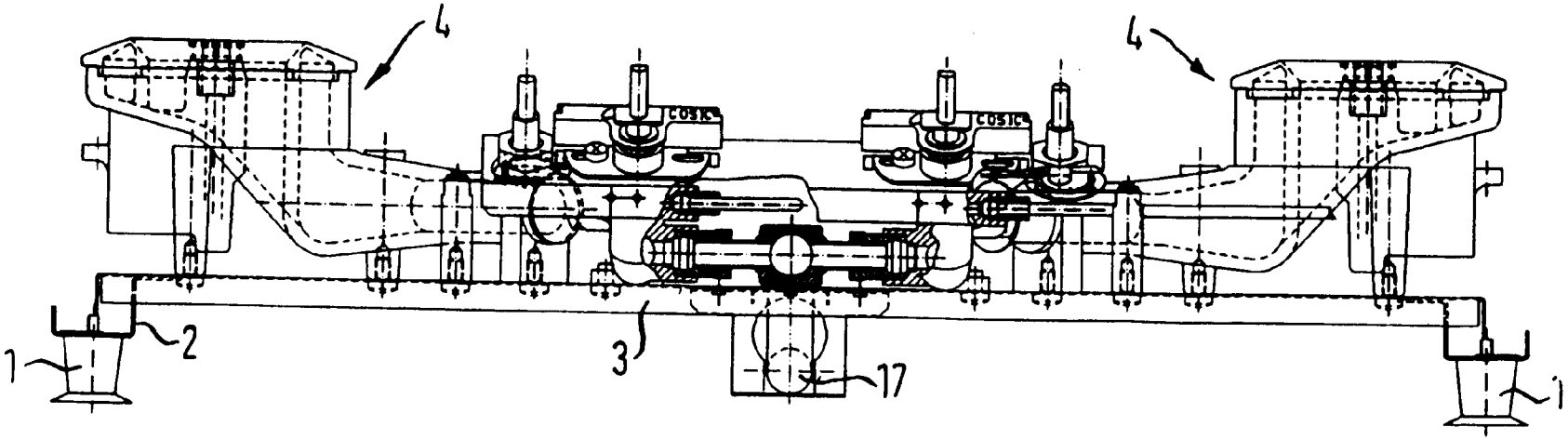
FIG. 3 is a front-elevational view of such a configuration.

Referring now to the figures of the drawings in detail and first, particularly, to FIGS. 1 and 2 thereof, there are seen gas burner configurations or heads 4 and associated gas fittings 5 for two cooking areas which are fastened on a basic frame including two angle strips 2 fitted with feet 1 and a baseplate 3 situated therebetween. The gas burner configurations 4, which are of completely similar structure, each have two burner rings, specifically an inner burner 6 and an outer burner 7 disposed around the latter. The gas burner configurations 4 are aligned in a V-shaped manner in the direction of the gas fittings 5 with their feed duct for a gas/air mixture intended for the outer burner 7. A connection for a gas line 9 is provided in a plane perpendicular to a gas/air feed duct 8 for the outer burner 7 in an oppositely disposed manner in a lower region of the burner head of each of the gas burner configurations 4. The gas line 9 departs from a respective fitting 5 and leads to a gas injector nozzle configuration 10 disposed in the burner head of the gas burner configuration 4. An intake of primary air to the gas injector nozzle configuration is cleared through an opening 11 (FIG. 6) on the underside of the burner head. The gas mixes with primary air in a duct 12 (FIG. 2) leading to the inner burner 6 to form a mixture which burns well. Secondary air required for the inner burner 6, as well as a necessary partial quantity of secondary air for the outer burner 7, pass to flame regions through a clearance opening 19 (FIG. 2) between the inner burner 6 and the outer burner 7.

The gas coming from the fitting 5 is blown into the gas/air feed duct 8 through the use of a gas nozzle 13 (FIG. 2), which is a constituent of the fitting member, although primary air is entrained. An intensive mixing of gas blown in and air inducted toward the outer burner 7 takes place in the gas/air feed duct 8, which has an adequate length.

Figure 4:
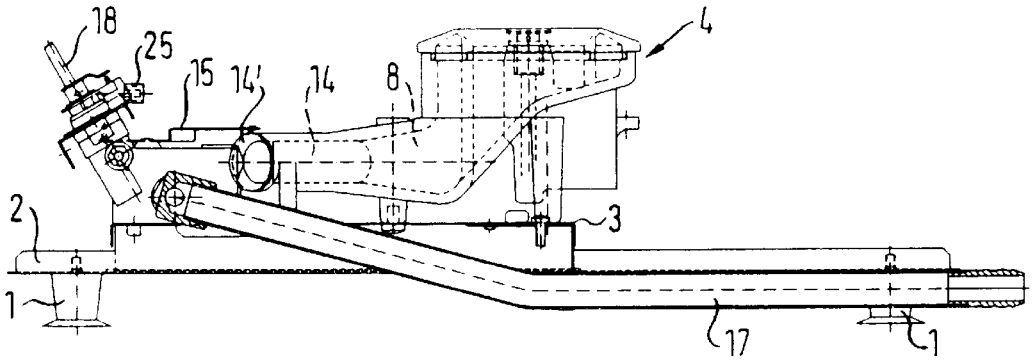
FIGS. 4 to 6 are partially-sectional, side-elevational views of burner units.
Figure 5:
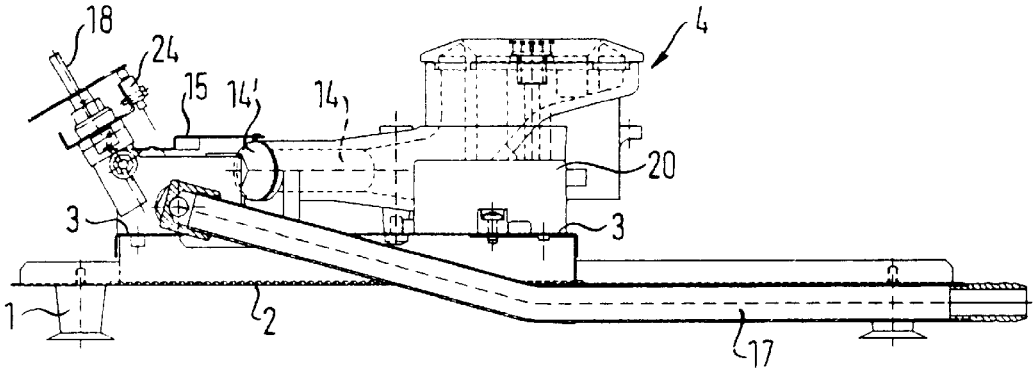
Figure 6:
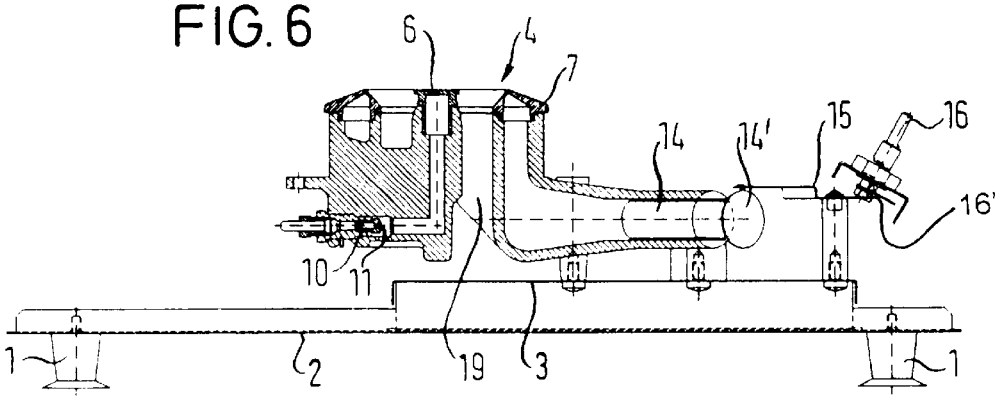

As is seen in FIGS. 4–6, in order to be able to adapt the air feed individually to the rate of outflow and type of gas being used, an inlet opening of the gas/air feed duct 8 is associated with an axially displaceable pipe connector or sleeve 14 having an induction funnel 14', through which an effective spacing of the gas/air feed duct or pipe 8 can be varied toward the nozzle 13. As a result thereof, the air induction can also be varied. This pipe connector 14 can be actuated by an angle lever 15 mounted in the baseplate 3, through the use of a finger-grip knob configuration or second setting member 16 having a non-illustrated actuating knob that projects from a likewise non-illustrated operating panel. The lever 15 has two lever arm ends 15' and a knee region 15". The knee region is mounted immovably and one lever arm end is coupled in a self-closing manner to the adjusting member or pipe 14 of the air inlet opening of the gas/air feed duct or pipe 8. A sliding guide 16' couples the other lever arm end to the second setting member 16.

A gas feed for the gas burner configurations 4 of the two cooking areas of a cooker hob or cool top platform is performed centrally through a gas line 17 which is connected to the two fittings 5 in a branched manner like a T between the two fittings 5. The two fittings 5 are constructed and disposed symmetrically relative to one another. They each contain three gas duct branches which can be opened and closed by a finger-grip knob configuration or first setting member 18, through a non-illustrated actuating knob projecting above the operating panel. One of the gas duct branches in the fitting 5 is constructed for constant gas throughput and is associated with the inner burner 6 through the gas feed line 9. After an initial rotary movement of the finger grip knob configuration 18, this gas duct branch is fully opened, specifically for the entire further adjustment path of this finger-grip knob configuration 18. The flame at the inner burner 6 can also be ignited in the initial position, in which this gas duct branch is open. An igniting electrode 20 is disposed in the vicinity of the inner burner 6 for this purpose. An ignition voltage for generating an igniting spark is generated in the case of the embodiment according to FIG. 1 and FIG. 5 with the aid of an ignition generator 21 which is activated by a contact 24 that can be actuated by the finger-grip knob configuration 18, for example by pressing in axially. In the case of the embodiment according to FIG. 2 and FIG. 4, an ignition is generated by actuating a piezoelectric element 25 on which the finger-grip knob configuration 18 acts. This occurs by virtue of the fact that a striking movement is exerted on the piezoelectric element 25 at the instant when the gas duct branch is opened, which is prepared by a preliminary rotary movement or pressing-in movement of the finger-grip knob configuration.

As may be seen from FIG. 1, a thermocouple 22 is also disposed in the vicinity of the inner burner 6, if required. A main valve 23 for the exit of gas is held open by the thermocouple 22, as long as the flame is present at the inner burner 6.

After a further angle of rotation, after which the first gas duct branch is open for the inner burner 6, and the flame has been ignited at the inner burner, two further gas duct branches are completely opened. The further gas duct branches are associated with the nozzle 13 and thus with the outer burner 7 of each of the gas burner configurations 4. The flame of the outer burner is ignited from the flame of the inner burner 6 in this case. One of the two gas duct branches associated with the outer burner 7 and led to the gas nozzle 13 is variable with reference to the gas flow rate, and can be completely closed by the end of a prescribed angle of rotation of the finger-grip knob configuration. The second of the gas duct branches led to the gas nozzle 13 remains fully open during this time and serves to ensure that gas is fed to the outer burner 7 in conjunction with the minimum heating power.

The structure and configuration of the gas burners for the two cooking areas are conceived and selected in such a way that recourse may be made to components which are as simple and similar as possible for the two cooking area units. The gas fittings 5 and their associated adjusting mechanisms for adding air in the region of the nozzles 13 are constructed in the manner of mirror images and correspond as far as possible. The structure of the two-ring gas burner configurations 4 is completely identical in each case. Nevertheless, this structure permits the actuating elements for the separately situated cooking area regions to be moved near one another on the front operating panel and to form an actuating block.

I claim:

1. A gas burner configuration for cooking areas, comprising:

a gas burner disposed at a gas burner site;

a gas fitting for feeding gas to said gas burner;

a gas injector nozzle configuration disposed between said gas fitting and said gas burner site, said gas injector nozzle configuration having a pipe leading to said gas burner, said pipe having an air inlet opening formed therein, and said gas injector nozzle configuration having a longitudinally displaceable adjusting pipe and a gas outlet nozzle disposed in the vicinity of said air inlet opening;

a first setting member for adjusting said gas fitting; and a second setting member disposed in the vicinity of said first setting member and independent of said first setting member for adjusting said air inlet opening of said gas injector nozzle configuration.

2. The gas burner configuration according to claim 1, wherein said adjusting pipe is a sleeve acting as an adjusting member for varying said air inlet opening of said gas injector nozzle configuration, said pipe is a gas/air feed duct leading to said burner head, and said sleeve is adjustable in alignment with said gas/air feed duct.

3. The gas burner configuration according to claim 2, including a lever having two lever arm ends and a knee region, said knee region mounted immovably, one of said lever arm ends coupled in a self-closing manner to said adjusting member of said air inlet opening of said gas/air feed duct, and a sliding guide coupling the other of said lever arm ends to said second setting member.

4. The gas burner configuration according to claim 1, wherein said second setting member is a finger-grip knob configuration with a sliding guide.

* * * * *